US009073668B1

(12) United States Patent
Catania et al.

(10) Patent No.: US 9,073,668 B1
(45) Date of Patent: Jul. 7, 2015

(54) MIXING BUCKET WITH FOOT SUPPORT

(71) Applicants: Michael Catania, Coconut Creek, FL (US); Peter Pino, Coconut Creek, FL (US)

(72) Inventors: Michael Catania, Coconut Creek, FL (US); Peter Pino, Coconut Creek, FL (US)

( * ) Notice: Subject to any disclaimer, the term of this patent is extended or adjusted under 35 U.S.C. 154(b) by 0 days.

(21) Appl. No.: 14/310,014

(22) Filed: Jun. 20, 2014

(51) Int. Cl.
*B65D 25/24* (2006.01)
*B65D 25/20* (2006.01)

(52) U.S. Cl.
CPC ..... *B65D 25/20* (2013.01); *B65D 25/24* (2013.01)

(58) Field of Classification Search
CPC ..... B65D 25/20; B65D 25/24; B62B 5/0083; B62B 2202/028; B62B 3/104; B62B 5/0093
USPC ..... 280/79.2, 79.5; 248/129
See application file for complete search history.

(56) References Cited

U.S. PATENT DOCUMENTS

| | | | | |
|---|---|---|---|---|
| D220,972 | S | 6/1971 | Yates | |
| 4,998,696 | A * | 3/1991 | Desjardins | 248/146 |
| 5,183,280 | A * | 2/1993 | Gresch | 280/79.5 |
| 6,209,891 | B1 * | 4/2001 | Herrmann | 280/32.6 |
| 6,464,184 | B1 | 10/2002 | Lytle | |
| 7,178,766 | B2 | 2/2007 | Forshee | |
| 7,261,262 | B2 | 8/2007 | Dunson | |
| 7,597,392 | B1 * | 10/2009 | Gilmore | 297/217.1 |
| 7,651,060 | B2 * | 1/2010 | Roth et al. | 248/146 |
| 8,033,417 | B1 | 10/2011 | Fallacaro | |
| 8,136,691 | B2 | 3/2012 | Saunders | |
| D660,540 | S * | 5/2012 | Thompson et al. | D34/17 |
| 2008/0272566 | A1 * | 11/2008 | Thompson | 280/79.5 |
| 2012/0286486 | A1 * | 11/2012 | Varney et al. | 280/47.11 |

FOREIGN PATENT DOCUMENTS

WO WO2006099581 11/2007

* cited by examiner

*Primary Examiner* — John Walters
*Assistant Examiner* — Brian Swenson
(74) *Attorney, Agent, or Firm* — Kyle A. Fletcher, Esq.

(57) ABSTRACT

The container assembly includes a bucket that may contain a material. The foot opening extends through the bucket proximate a bottom of the bucket. A plurality of wheels is operationally coupled to the bucket. The bucket is movable along a support surface.

16 Claims, 4 Drawing Sheets

MIXING BUCKET WITH FOOT SUPPORT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of mixing buckets, more specifically, mixing buckets with foot supports.

SUMMARY OF THE INVENTION

An embodiment of the disclosure meets the needs presented above by generally comprising a bucket that may contain a material. The foot opening extends through the bucket proximate a bottom of the bucket. A plurality of wheels is operationally coupled to the bucket. The bucket is movable along a support surface.

An object of the invention is to provide a device that is mixing bucket with foot support.

These together with additional objects, features and advantages of the mixing bucket with foot support will be readily apparent to those of ordinary skill in the art upon preferred, but nonetheless illustrative, embodiments of the mixing bucket with foot support when taken in conjunction with the accompanying drawings.

In this respect, before explaining the current embodiments of the mixing bucket with foot support in detail, it is to be understood that the mixing bucket with foot support is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the mixing bucket with foot support.

It is therefore important that the claims be regarded as including such equivalent construction insofar as they do not depart from the spirit and scope of the mixing bucket with foot support. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
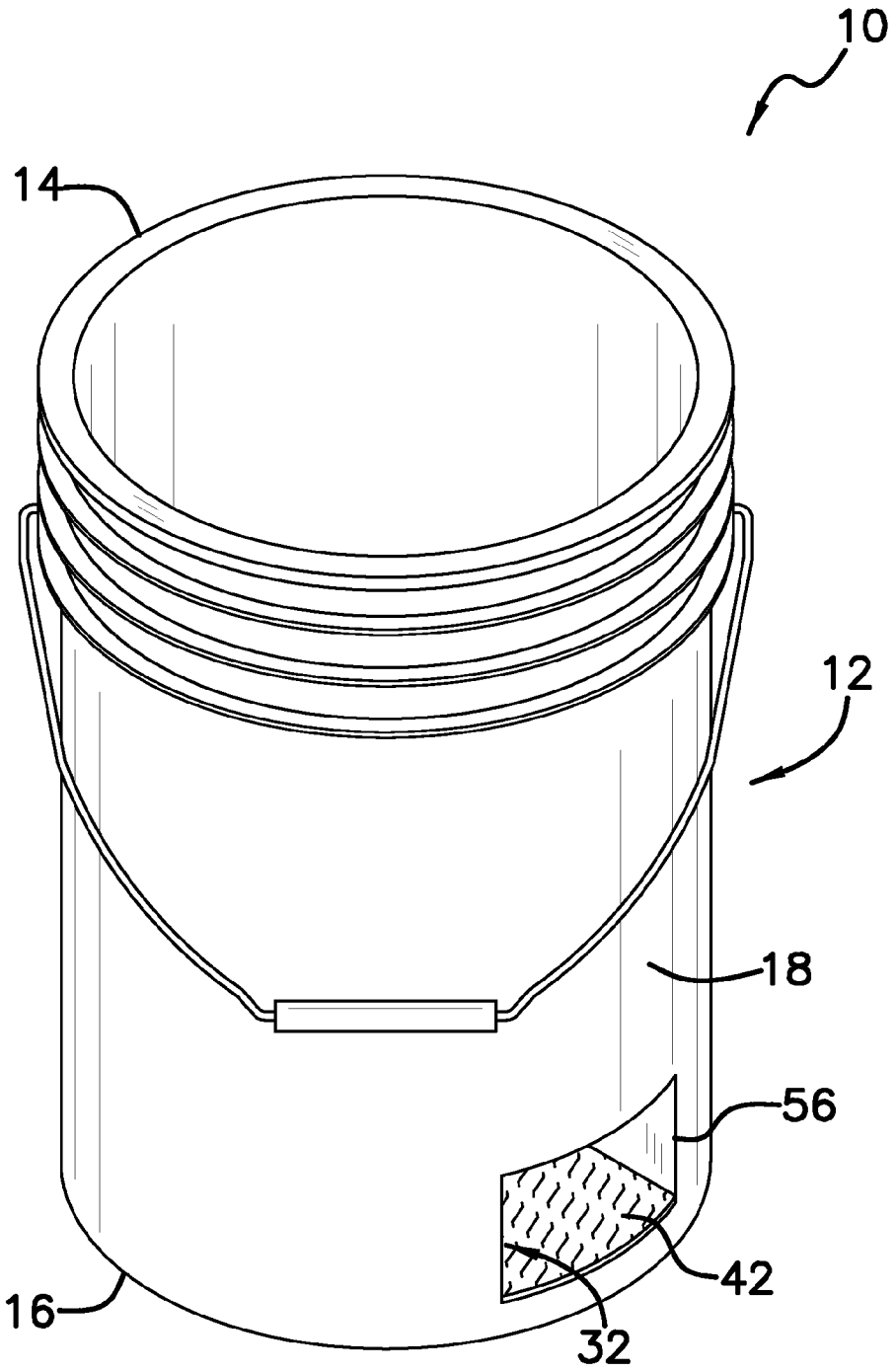
FIG. 1 is a perspective view of a container assembly according to an embodiment of the disclosure.
Figure 2:
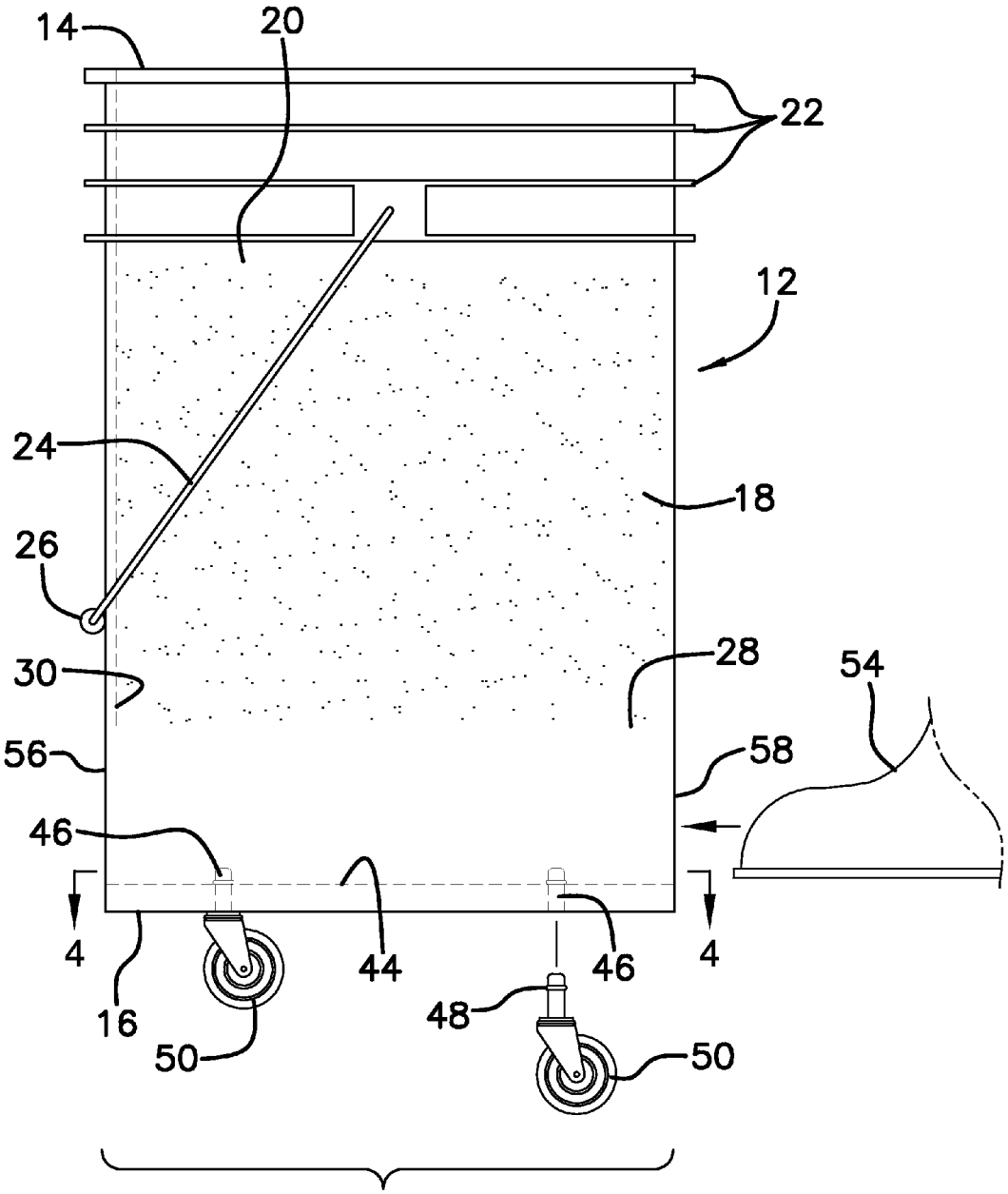
FIG. 2 is a right side view of an embodiment of the disclosure.
Figure 3:
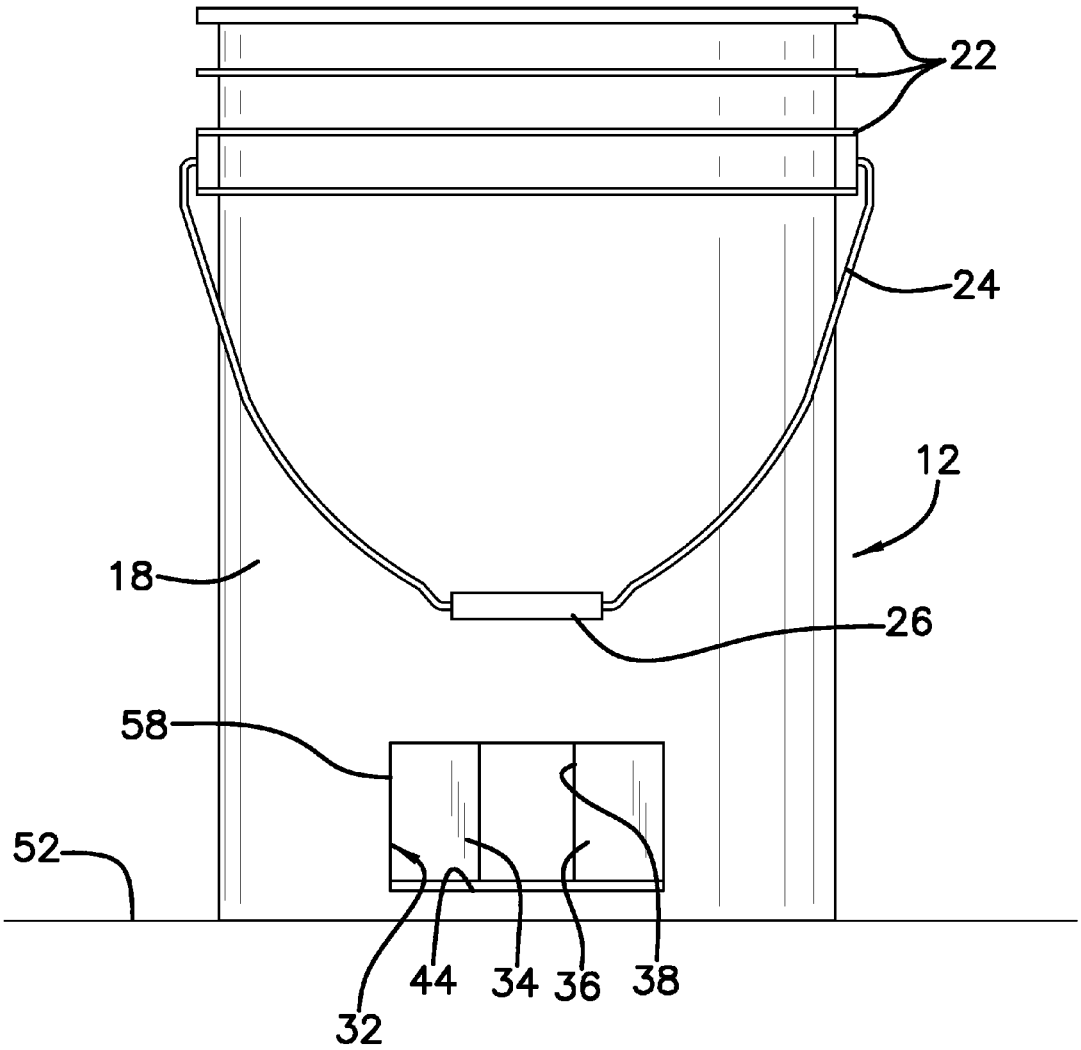
FIG. 3 is a front view of an embodiment of the disclosure.
Figure 4:
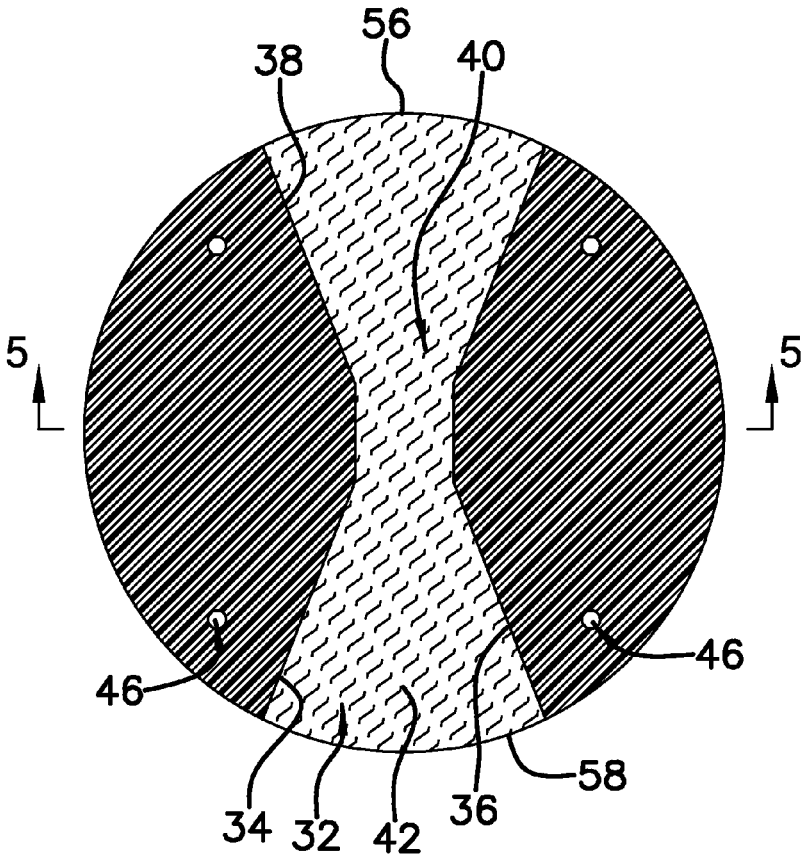
FIG. 4 is a cross sectional view taken along line 4-4 of FIG. 2 of an embodiment of the disclosure.
Figure 5:
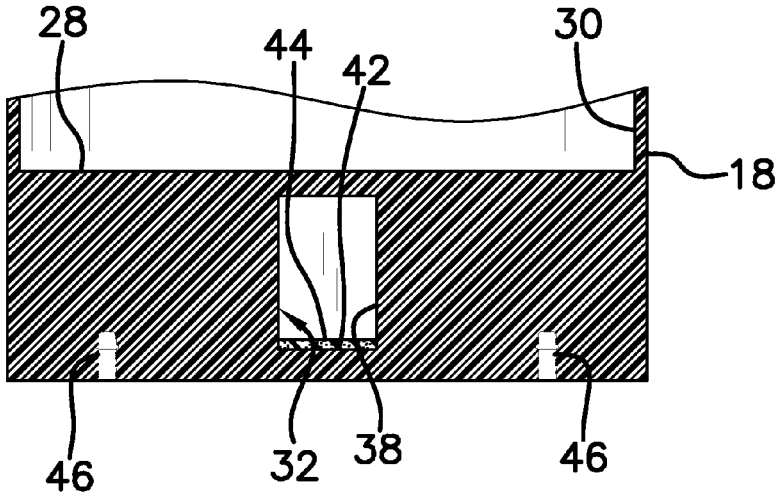
FIG. 5 is a cross sectional view taken along line 5-5 of FIG. 4 of an embodiment of the disclosure.

As best illustrated in FIGS. 1 through 5, the container assembly 10 generally comprises a bucket 12 that has a top end 14 and a bottom end 16. The top end 14 of the bucket 12 is open. The bucket 12 has an outer wall 18 extending between the top end 14 and the bottom end 16 of the bucket 12. The outer wall 18 of the bucket 12 is curvilinear. Moreover, the bucket 12 has a cylindrical shape. The bucket 12 may contain a material 20.

A plurality of ribs 22 extends outwardly from the outer wall 18 of the bucket 12. The plurality of ribs 22 extends around an entire circumference of the bucket 12. Moreover, the plurality of ribs 22 are evenly spaced apart and positioned proximate the top end 14 of the bucket 12.

A handle 24 is movably coupled to the outer wall 18 of the bucket 12. A grip 26 is movably coupled to the handle 24. The grip 26 may be gripped. The grip 26 is gripped so the bucket 12 may be carried.

The bucket 12 has a medial wall 28. The medial wall 28 is coextensively coupled to an inside surface 30 of the outer wall 18 of the bucket 12. The medial wall 28 is spaced upwardly from the bottom end 16 of the bucket 12.

A foot opening 32 extends completely through the outer wall 18 of the bucket 12. The foot opening 32 is centrally positioned on the outer wall 18 of the bucket 12. The foot opening 32 is positioned between the bottom end 16 of the bucket 12 and the medial wall 28 of the bucket 12. Each of a first lateral side 34 and a second lateral side 36 of a bounding edge 38 of the foot opening 32 flares inwardly proximate a center 40 of the foot opening 32. The foot opening 32 has an hourglass shaped cross section taken perpendicular to a longitudinal axis extending through the top end 14 and the bottom end 16 of the bucket 12.

A pad 42 is coupled to a bottom surface 44 of the bounding edge 38 of the foot opening 32. The pad 42 completely covers the bottom surface 44 of the bounding edge 38 of the foot opening 32. The pad 42 may be comprised of a non-slip material.

The bottom end 16 of the bucket 12 has a plurality of wheel wells 46 extending upwardly therein. The plurality of wheel wells 46 is evenly spaced apart and distributed around an entire circumference of the bucket 12. A peg 48 on each of a plurality of wheels 50 is insertably positionable within an associated one of the plurality of wheel wells 46. The plurality of wheels 50 supports the bucket 12 above a support surface 52. The bucket 12 is movable along the support surface 52.

In use, a user's foot 54 is inserted into a selected one of a primary end 56 or a secondary end 58 of the foot opening 32. The user's foot 54 engages the pad 42 in the foot opening 32. The user's foot 54 keeps the bucket 12 stationary on the support surface 52. Additionally, the user's foot 54 prevents the bucket 12 from tipping over.

With respect to the above description, it is to be realized that the optimum dimensional relationship for the various components of the container assembly 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the container assembly 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A container assembly having a foot opening configured to receive a user's foot wherein said assembly is retained in a selected position, said assembly comprising:

a bucket configured to contain a material;

said foot opening extending through said bucket proximate a bottom of said bucket;

a plurality of wheels operationally coupled to said bucket wherein said bucket is movable along a support surface;

wherein said foot opening being positioned between a bottom end of said bucket and a medial wall of said bucket;

wherein each of a first lateral side and a second lateral side of a bounding edge of said foot opening flaring inwardly proximate a center of said foot opening;

wherein said foot opening has an hourglass shaped cross section taken perpendicular to a longitudinal axis extending through a top end and a bottom end of said bucket.

2. The assembly according to claim 1, wherein said bucket having a top end and a bottom end.

3. The assembly according to claim 2, wherein said top end of said bucket being open.

4. The assembly according to claim 1, wherein said bucket having an outer wall extending between a top end and a bottom end of said bucket.

5. The assembly according to claim 4, wherein said outer wall of said bucket being curvilinear such that said bucket has a cylindrical shape.

6. The assembly according to claim 1, wherein said bucket having a medial wall being coextensively coupled to an inside surface of an outer wall of said bucket.

7. The assembly according to claim 6, wherein said medial wall being spaced upwardly from a bottom end of said bucket.

8. The assembly according to claim 1, wherein said foot opening extending completely through an outer wall of said bucket.

9. The assembly according to claim 1, wherein a bottom end of said bucket having a plurality of wheel wells extending upwardly therein.

10. The assembly according to claim 9, wherein said plurality of wheel wells being evenly spaced apart and distributed around an entire circumference of said bucket.

11. The assembly according to claim 1, wherein a peg on each of said plurality of wheels being insertably positionable within an associated one of a plurality of wheel wells.

12. The assembly according to claim 1, wherein said plurality of wheels supporting said bucket above the support surface.

13. A container assembly having a foot opening configured to receive a user's foot wherein said assembly is retained in a selected position, said assembly comprising:

a bucket having a top end and a bottom end, said bucket being configured to contain a material;

said foot opening extending through said bucket proximate a bottom of said bucket;

a plurality of wheels operationally coupled to said bucket wherein said bucket is movable along a support surface;

wherein said bucket having a medial wall being coextensively coupled to an inside surface of an outer wall of said bucket; said medial wall being spaced upwardly from said bottom end of said bucket; said foot opening extending completely through said outer wall of said bucket; said foot opening being positioned between said bottom end of said bucket and said medial wall of said bucket.

14. The assembly according to claim 13, wherein said top end of said bucket being open; said bucket having an outer wall extending between said top end and said bottom end of said bucket; said outer wall of said bucket being curvilinear such that said bucket has a cylindrical shape.

15. The assembly according to claim 13, wherein each of a first lateral side and a second lateral side of a bounding edge of said foot opening flaring inwardly proximate a center of said foot opening wherein said foot opening has an hourglass shaped cross section taken perpendicular to a longitudinal axis extending through said top end and said bottom end of said bucket.

16. The assembly according to claim 13, wherein said bottom end of said bucket having a plurality of wheel wells extending upwardly therein; said plurality of wheel wells being evenly spaced apart and distributed around an entire circumference of said bucket; a peg on each of said plurality of wheels being insertably positionable within an associated one of said plurality of wheel wells; said plurality of wheels supporting said bucket above the support surface.

* * * * *